US008485869B2

(12) United States Patent
Feng et al.

(10) Patent No.: US 8,485,869 B2
(45) Date of Patent: Jul. 16, 2013

(54) POLISHING MATERIAL HAVING POLISHING PARTICLES AND METHOD FOR MAKING THE SAME

(75) Inventors: Chung-Chih Feng, Kaohsiung (TW); I-Peng Yao, Kaohsiung (TW); Lyang-Gung Wang, Kaohsiung (TW); Yung-Chang Hung, Kaohsiung (TW); Chao-Yuan Tsai, Kaohsiung (TW)

(73) Assignee: San Fang Chemical Industry Co., Ltd., Kaohsiung (TW)

( * ) Notice: Subject to any disclaimer, the term of this patent is extended or adjusted under 35 U.S.C. 154(b) by 0 days.

(21) Appl. No.: 12/889,553

(22) Filed: Sep. 24, 2010

(65) Prior Publication Data

US 2011/0011007 A1 Jan. 20, 2011

Related U.S. Application Data

(62) Division of application No. 11/702,217, filed on Feb. 5, 2007, now Pat. No. 7,824,249.

(51) Int. Cl.
*B24D 11/00* (2006.01)
*B24B 37/24* (2012.01)

(52) U.S. Cl.
USPC ..... 451/527; 51/293; 451/532

(58) Field of Classification Search
USPC ..... 51/295, 293, 298; 451/41, 426, 427, 451/430, 432, 527, 532
See application file for complete search history.

(56) References Cited

U.S. PATENT DOCUMENTS 3,701,703 A 10/1972 Zimmer et al.
4,078,340 A * 3/1978 Klecker et al. ..... 51/295
4,082,521 A 4/1978 McGarvey
4,497,694 A 2/1985 Bankier et al.
4,728,552 A * 3/1988 Jensen, Jr. ..... 428/91
4,927,432 A 5/1990 Budinger et al.
5,094,670 A 3/1992 Imada
5,913,715 A * 6/1999 Kirchner et al. ..... 451/56
6,095,902 A * 8/2000 Reinhardt ..... 451/36
6,095,908 A 8/2000 Torii (Continued)

FOREIGN PATENT DOCUMENTS

CN 1438930 A 8/2003
CN 1814410 A 8/2006

(Continued)

OTHER PUBLICATIONS

Peoples Republic of China Office Action dated Jul. 31, 2009 in corresponding Peoples Republic of China Patent Application No. 2007100800115.

*Primary Examiner* — Pegah Parvini
(74) *Attorney, Agent, or Firm* — Sughrue Mion, PLLC

(57) ABSTRACT

The present invention relates to a polishing material having polishing particles and a method for making the same. The polishing material having polishing particles includes a base material, a plurality of polishing particles and a polymer elastic body. The base material has a plurality of fibers for defining a plurality of grid-spaces. The polishing particles are distributed in the grid-spaces. The polymer elastic body covers the base material and the polishing particles. Whereby, the polishing particles are uniformly distributed on a surface of a polishing workpiece during the polishing process. Furthermore, the base material prevents the polishing particles from contacting the polishing workpiece so as to avoid the scratch of the polishing workpiece. Also, the base material provides effects for sweeping the small grinded pieces.

10 Claims, 4 Drawing Sheets

U.S. PATENT DOCUMENTS

| | | | | |
|---|---|---|---|---|
| 6,477,926 | B1 * | 11/2002 | Swisher et al. | 451/526 |
| 6,848,986 | B2 * | 2/2005 | Kendall et al. | 451/526 |
| 2003/0013397 | A1 | 1/2003 | Rhoades | |
| 2005/0282480 | A1 * | 12/2005 | Nelson et al. | 451/530 |
| 2006/0116059 | A1 | 6/2006 | Chen et al. | |
| 2007/0066186 | A1 * | 3/2007 | Annen et al. | 451/41 |

FOREIGN PATENT DOCUMENTS

| | | | |
|---|---|---|---|
| CN | 1843701 | A | 10/2006 |
| JP | 59118374 | * | 7/1984 |
| TW | 490364 | B | 6/2002 |

* cited by examiner

POLISHING MATERIAL HAVING POLISHING PARTICLES AND METHOD FOR MAKING THE SAME

This is a Divisional of application Ser. No. 11/702,217 filed Feb. 5, 2007. The entire disclosure of the prior application, application Ser. No. 11/702,217 is hereby incorporated by reference.

BACKGROUND OF THE INVENTION

1. Field of the Invention

The present invention relates to a polishing material and a method for making the same, and more particularly to a polishing material having polishing particles and a method for making the same.

2. Description of the Related Art

Generally, polishing refers to grinding a rough surface through a chemical mechanical polishing (CMP) process. Particularly, a polishing slurry having polishing particles is uniformly distributed on a surface of a polishing pad, and meanwhile, a workpiece to be polished bears against the polishing pad, then, a repeated and regular rubbing operations are performed. The workpiece to be polished includes, for example, a semiconductor, a storage medium substrate, an integrated circuit, an LCD flat glass, an optical glass, or a photoelectric panel, etc.

FIG. 1 is a schematic view of a conventional polishing pad. The conventional polishing pad 1 does not have polishing particles, and has a plurality of grooves 11 on a surface of the polishing pad 1. When performing a polishing process on a workpiece to be polished (not shown), a polishing slurry containing polishing particles is applied between the workpiece to be polished and the polishing pad 1, and thus, the polishing particles in the polishing slurry are used for polishing. However, the distribution of the polishing slurry between the workpiece to be polished and the polishing pad 1 is restricted by the design of the grooves 11, so that the polishing particles cannot be uniformly distributed, and thus the polishing efficiency is reduced and the used polishing slurry easily causes pollution.

FIG. 2 is a schematic view of a conventional polishing pad disclosed in U.S. Pat. No. 5,692,950. The polishing pad 2 comprises a base 21, an adhesion layer 22, and a polishing layer 23. The base 21 comprises an elastic layer 211 and a stiff layer 212. The adhesion layer 22 is disposed on the stiff layer 212. The polishing layer 23 comprises a backing layer 231 and a polishing structure 232, wherein the backing layer 231 is disposed on the adhesion layer 22. The polishing structure 232 has a predetermined pattern and a plurality of fixed polishing particles 233. The polishing particles 233 are distributed within the polishing structure 232 and on the surface of the polishing structure 232.

Similarly, when polishing a workpiece to be polished (not shown), a polishing slurry containing polishing particles is applied between the workpiece to be polished and the polishing pad 2, so as to enhance the polishing effect. Although the polishing pad 2 has the polishing particles 233, the main body of the polishing structure 232 is a PU material with independent foam, and the polishing particles 233 exist in the individual holes of the polishing structure 232, and thus the polishing particles 233 have no fluidity. During the polishing process, the polishing particles 233 on the surface of the polishing structure 232 directly contact the surface of the workpiece to be polished, or after the polishing structure 232 has been polished for a period of time, the polishing particles 233 within the polishing structure 232 are exposed and directly contact the surface of the workpiece to be polished, thus causing the surface of the polished workpiece to be scratched.

Consequently, there is an existing need for providing a polishing material having polishing particles and a method for making the same to solve the above-mentioned problems.

SUMMARY OF THE INVENTION

One objective of the present invention is to provide a polishing material having polishing particles. The polishing material having polishing particles comprises a base material, a plurality of polishing particles, and a polymer elastic body. The base material has a plurality of fibers for defining a plurality of grid-spaces. The polishing particles are distributed in the grid-spaces. The polymer elastic body covers the base material and the polishing particles.

Another objective of the present invention is to provide a method for making a polishing material having polishing particles, which comprises: (a) providing a base material having a plurality of fibers for defining a plurality of grid-spaces; (b) immersing the base material in a polymer solution containing a plurality of polishing particles, such that the polishing particles are distributed in the grid-spaces; and (c) solidifying the polymer solution attached to the base material to form a polymer elastic body that covers the base material and the polishing particles.

By using the polishing material having polishing particles and the method for making the same of the present invention, the polishing particles are uniformly distributed on the surface of the workpiece for being polished during the polishing process. Therefore, the polishing material having polishing particles and the method for making the same of the present invention is capable of solving the problem of the reduced polishing effect and the pollution of the used polishing slurry caused by the conventional polishing material without containing polishing particles that the polishing particles in the polishing slurry are not uniformly distributed during the polishing process.

Moreover, the base material of the present invention prevents the polishing particles from directly contacting the polished workpiece, thus solving the problem of the surface of the polished workpiece to be scratched caused by the conventional polishing material as an independent foam material that the polishing particles are existed in the independent holes and have no fluidity. Moreover, the base material of the present invention also provides an effect for sweeping the small grinded pieces.

DETAILED DESCRIPTION OF THE INVENTION

The present invention provides a polishing material having polishing particles. The polishing material is applied in a chemical mechanical polishing (CMP) process for grinding or polishing a workpiece to be polished. The workpiece to be polished includes, but not limited to, a semiconductor, a storage medium substrate, an integrated circuit, an LCD flat glass, an optical glass, and a photoelectric panel, etc.

Figure 1:
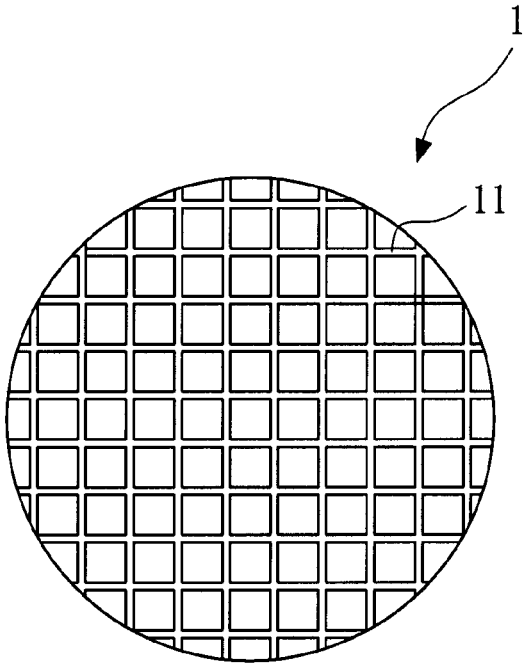
FIG. 1 (Prior Art)
FIG. 1 is a schematic view of a conventional polishing pad.
Figure 2:
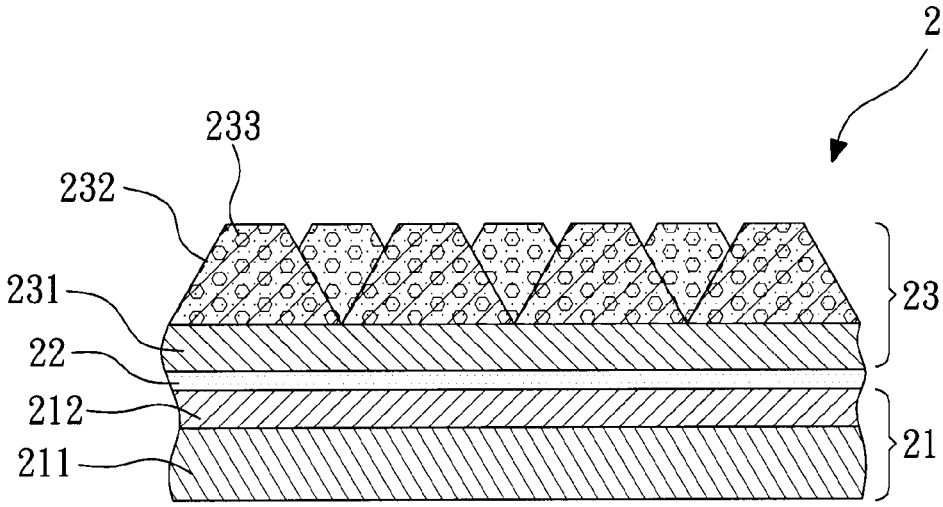
FIG. 2 (Prior Art)
FIG. 2 is a schematic view of a conventional polishing pad as disclosed in U.S. Pat. No. 5,692,950.
Figure 3:
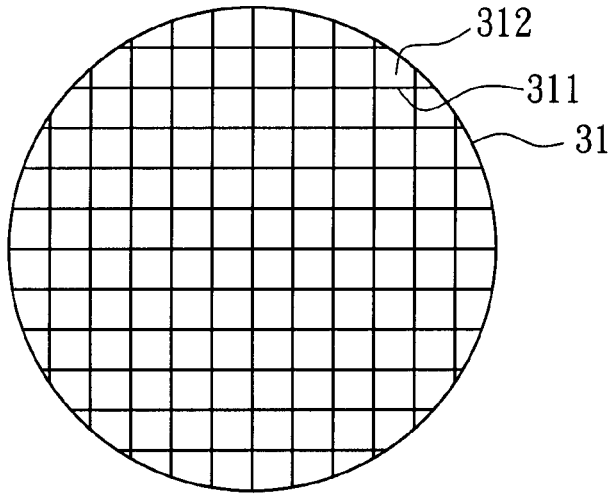
FIG. 3 is a schematic view of a base material of the present invention.

FIGS. 3 to 7 show a method for making the polishing material having polishing particles according to the present invention. Referring to FIG. 3, a base material 31 is firstly provided, which has a plurality of fibers 311 for defining a plurality of grid-spaces 312. Preferably, the thinness of the fibers 311 falls between 0.001 den and 10 den. The base material 31 is a fabric material, and it is a non-woven fabric in the embodiment. Preferably, the material of the fibers 311 is selected from a group consisting of polypropylene (PP), polyester (PET), nylon, or a combination thereof.

Figure 4:
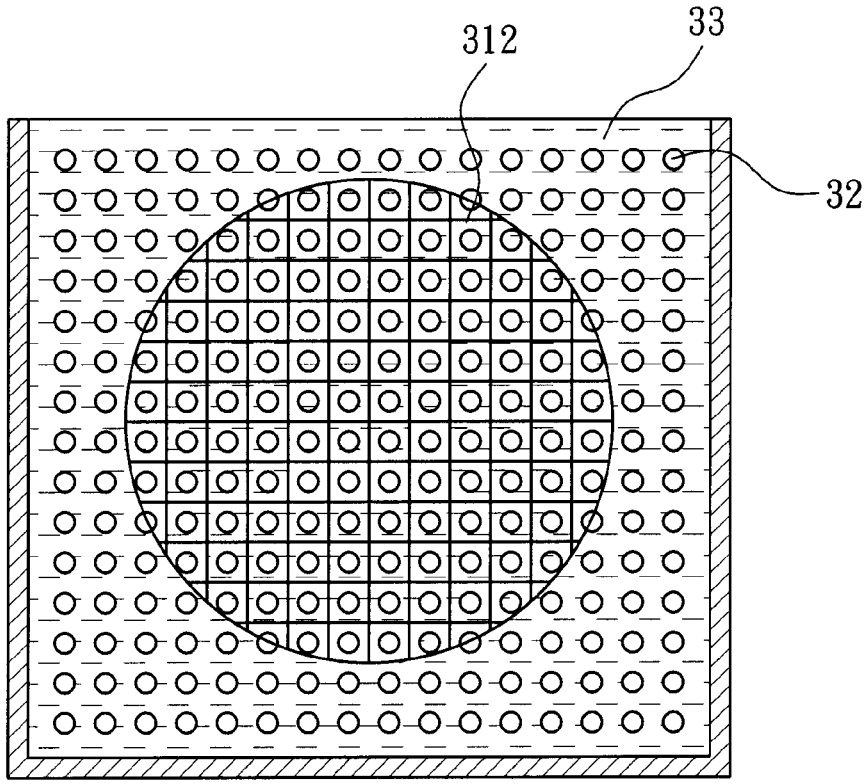
FIG. 4 is a schematic view of immersing the base material in a polymer solution containing a plurality of polishing particles according to the present invention.

Referring to FIG. 4, the base material 31 is immersed in a polymer solution 33 containing a plurality of polishing particles 32, such that the polishing particles 32 are uniformly distributed in the grid-spaces 312. In the embodiment, the polymer solution 33 is selected from polypropylene (PP), polyester (PET), or polyurethane resin. Preferably, the polishing particles 32 are selected from a group consisting of ceria, silicon dioxide, aluminum oxide, yttria, ferric oxide, or a combination thereof, and the diameter of the polishing particles 32 is between 0.01 μm and 10 μm.

Figure 5:
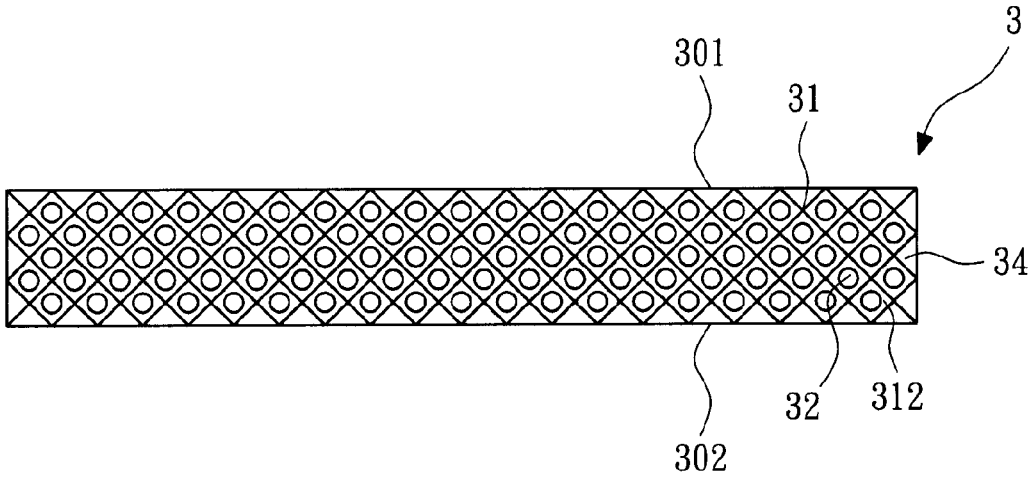
FIG. 5 is a sectional view of a polishing material having polishing particles of the present invention.

Referring to both FIGS. 4 and 5, the polymer solution 33 attached to the base material 31 is solidified to form a polymer elastic body 34 for covering the base material 31 and the polishing particles 32 in the grid-spaces 312, so as to form a polishing material 3 having polishing particles. The polishing material 3 having polishing particles has a first surface 301 and a second surface 302 corresponding to the first surface 301. In the embodiment, a step of coagulating the polymer solution 33 attached to the base material 31 is performed first, then, a washing step is performed, and finally, a baking step is performed for solidification, so as to form the polishing material 3 having polishing particles.

Figure 6:
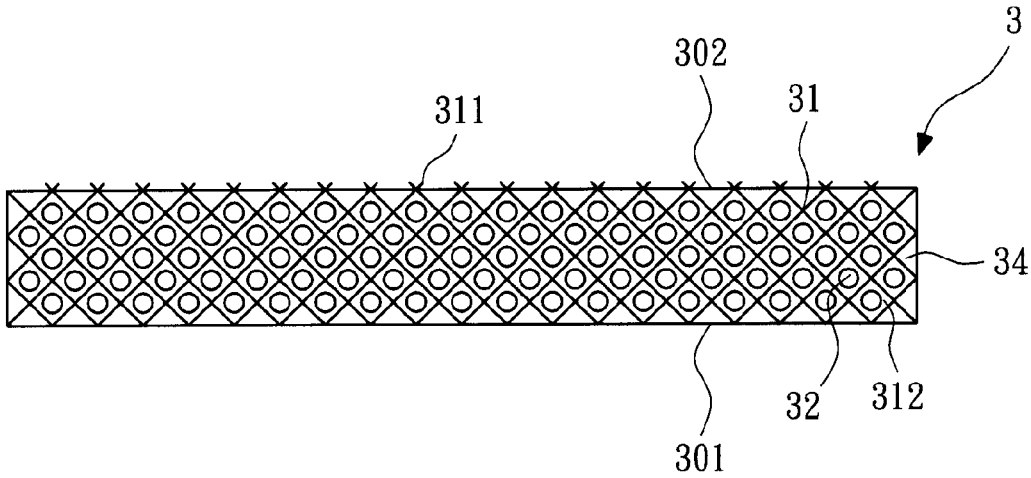
FIG. 6 is a sectional view of a polishing material having polishing particles with part of fibers being exposed when the surface is polished according to the present invention.

Referring to FIG. 6, after the solidifying step, the method of the invention preferably comprises a step of polishing the first surface 301, such that the first surface 301 has a preferred evenness. Then, the second surface 302 is trimmed, such that the polishing material 3 having polishing particles has an appropriate thickness. In the embodiment, the second surface 302 is used as a polishing surface for the polishing material 3 having polishing particles during the polishing process.

After the polishing material 3 having polishing particles is formed, the first surface 301 is first polished to obtain a relatively even surface, which ensures that the successively trimmed second surface 302 has a more preferred evenness, i.e., the polishing material 3 having polishing particles has a consistent thickness, and thus, the stress applied on the surface of the workpiece to be polished by the polishing material 3 having polishing particles during the polishing process is relatively uniform, so that a more even polished surface is produced. Moreover, since the polymer elastic body 34 is a harder material compared with the fibers 311 of the base material 31, when the second surface 302 is trimmed, a part of the polymer elastic body 34 of the second surface 302 is removed first, such that part of the fibers 311 is exposed on the second surface 302 of the polishing material 3 having polishing particles.

Figure 7:
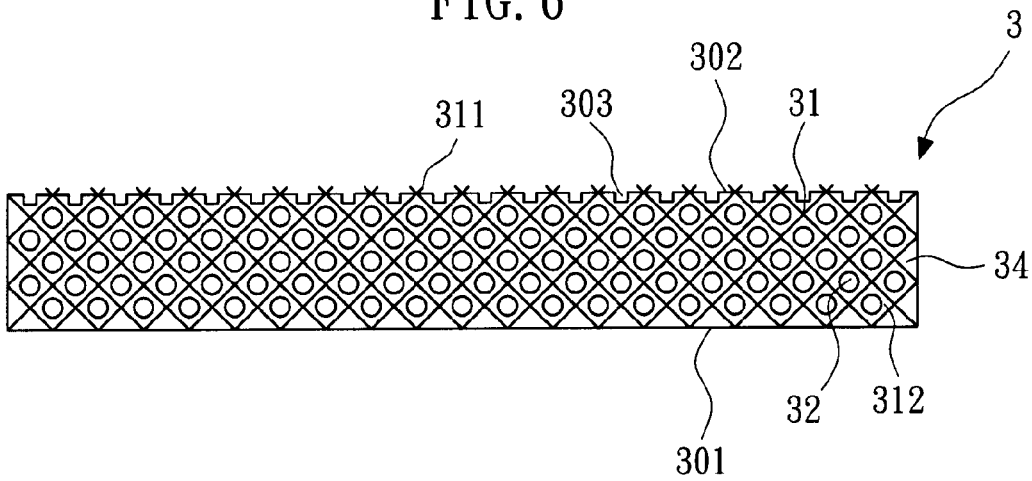
FIG. 7 is a sectional view of a polishing material having polishing particles with a plurality of grooves formed on the surface according to the present invention.

Referring to FIG. 7, after the step of trimming the second surface 302, the method of the invention preferably comprises a step of forming a plurality of grooves 303 on the second surface 302. According to various applications, the grooves 303 have a geometrical shape of triangle, square, or rectangle.

FIG. 7 shows a polishing material having polishing particles of the present invention. The polishing material 3 having polishing particles comprises a base material 31, a plurality of polishing particles 32, and a polymer elastic body 34. The base material 31 has a plurality of fibers 311 for defining a plurality of grid-spaces 312. Preferably, the thinness of the fibers 311 falls between 0.001 den and 10 den. The base material 31 is a fabric material, and it is a non-woven fabric in the embodiment. Preferably, the material of the fibers 311 is selected from a group consisting of polypropylene (PP), polyester (PET), nylon, or a combination thereof.

The polishing material 3 having polishing particles has a first surface 301 and a second surface 302 corresponding to the first surface 301, and part of the fibers 311 is exposed on the second surface 302 of the polishing material 3 having polishing particles. Therefore, the exposed fibers 311 prevent the polishing particles 32 from directly contacting the polished workpiece (not shown), and thus solving the conventional problem of the surface of the polished workpiece to be scratched caused by that the polishing particles of the polishing material with independent foam are existed in the independent holes and have no fluidity.

Moreover, according to the present invention, the fibers 311 exposed on the second surface 301 also provides an effect of sweeping the small grinded pieces, and solves the problem of the pollution caused by the used polishing slurry. In the embodiment, the polishing material 3 having polishing particles further comprises a plurality of grooves 303 formed on the second surface 302, and depending upon various applications, the grooves 303 may have a geometrical shape of triangle, square, or rectangle. The grooves 303 are formed to make the particles in the polishing slurry be more uniformly distributed, and by using the polishing particles 32 of the polishing material 3 together, a more preferred polishing effect can be achieved.

The polishing particles 32 are distributed in the grid-spaces 312. In the embodiment, the polishing particles 32 are selected from a group consisting of ceria, silicon dioxide, aluminum oxide, yttria, ferric oxide, or a combination thereof. Preferably, the diameter of the polishing particles 32 falls between 0.01 μm and 10 μm, such that the polishing particles 32 are uniformly distributed in the grid-spaces 312 defined by the fibers 311, and a preferred polishing efficiency is achieved during the polishing process.

The polymer elastic body 34 covers the base material 31 and the polishing particles 32, so as to form the polishing material 3 having polishing particles. In the embodiment, the polymer elastic body 34 is selected from polypropylene (PP), polyester (PET), or polyurethane resin, and the polymer elastic body 34 is a continuous foam body.

The polishing particles 32 of the present invention are uniformly distributed within and on the polishing material 3, thus a preferred effect of uniformly covering the polished surface is achieved during the polishing process. Furthermore, the base material 31 prevents the polishing particles 32 from directly contacting the polishing workpiece, so as to prevent the polishing workpiece from being scratched, and also provides an effect of sweeping the small grinded pieces.

While the embodiments of the present invention have been illustrated and described, various modifications and improvements can be made by those skilled in the art. The embodiments of the present invention are therefore described in an illustrative but not restrictive sense. It is intended that the present invention may not be limited to the particular forms as illustrated, and that all modifications that maintain the spirit and scope of the present invention are within the scope as defined in the appended claims.

What is claimed is:

1. A polishing material having polishing particles, comprising:

a base material, having a plurality of fibers for defining a plurality of grid-spaces;

a plurality of polishing particles, uniformly distributed in the grid-spaces; and a polymer elastic body, covering the base material and the polishing particles, wherein the polymer elastic body is a continuous foam body, and part of the fibers is exposed on a surface of the polishing material.

2. The polishing material according to claim 1, wherein the base material is a fabric material.

3. The polishing material according to claim 2, wherein the material of the fibers is selected from a group consisting of polypropylene (PP), polyester (PET), and nylon, or a combination thereof.

4. The polishing material according to claim 3, wherein the fabric material is a non-woven fabric.

5. The polishing material according to claim 1, wherein the polymer elastic body is selected from polypropylene (PP), polyester (PET), or polyurethane resin.

6. The polishing material as claimed in claim 1, wherein the thinness of the fibers is between 0.001 den and 10 den.

7. The polishing material according to claim 1, wherein the polishing particles are selected from a group consisting of ceria, silicon dioxide, aluminum oxide, yttria, ferric oxide, or a combination thereof.

8. The polishing material according to claim 7, wherein the diameter of the polishing particles is between 0.01 μm and 10 μm.

9. The polishing material according to claim 1, further comprising a plurality of grooves formed on a surface of the polishing material.

10. The polishing material according to claim 9, wherein the grooves have a geometrical shape of triangle, square, or rectangle.

* * * * *